US005529228A

United States Patent [19]

Biagi

[11] Patent Number: 5,529,228

[45] Date of Patent: Jun. 25, 1996

[54] MESH LIQUID CONTAINER CARRIER

[76] Inventor: Matthew Biagi, 415 Higgins St., Humble, Tex. 77338

[21] Appl. No.: 380,604

[22] Filed: Jan. 30, 1995

[51] Int. Cl.[6] ..... A45F 5/00

[52] U.S. Cl. ..... 224/148.5; 224/257; 224/602; 383/117

[58] Field of Search ..... 224/202, 148, 224/224, 917, 257; 383/117, 7, 8; D3/229; 248/102; 150/107

[56] References Cited

U.S. PATENT DOCUMENTS

| | | | |
|---|---|---|---|
| D. 335,957 | 6/1993 | Cantrell et al. | 224/148 |
| 1,808,375 | 6/1931 | Plooster | 383/8 |
| 3,322,176 | 5/1967 | Geller | 383/117 |
| 3,490,507 | 1/1970 | Grashorn | 383/117 |
| 3,756,300 | 9/1973 | Nalle, Jr. | 383/117 |
| 4,197,890 | 4/1980 | Simko | D3/229 |
| 4,753,538 | 6/1988 | Jorda | 383/117 |
| 4,877,336 | 10/1989 | Peppiatt | 383/8 |
| 4,942,809 | 7/1990 | Simmons | 383/117 |
| 4,979,833 | 12/1990 | Cook | 383/117 |
| 5,407,111 | 4/1995 | Lanouette et al. | 224/224 |
| 5,423,586 | 6/1995 | Fuller | 383/117 |
| 5,425,513 | 6/1995 | Shainker | 383/8 |
| 5,472,280 | 12/1995 | Rittmaster | 383/117 |

FOREIGN PATENT DOCUMENTS

| | | | |
|---|---|---|---|
| 157220 | 3/1953 | Australia | 383/117 |
| 209796 | 6/1960 | Germany | 383/117 |

*Primary Examiner*—Henry J. Recla
*Assistant Examiner*—Gregory M. Vidovich

[57] ABSTRACT

An embodiment of mesh joined together to hold a liquid container while the area of mesh not joined creates a loop that can be used as a strap to be worn around the body of an individual. The length of the longitudinal embodiment of the mesh that does not hold the liquid container can be tied in a knot at any area adjusting the length of the strap.

1 Claim, 1 Drawing Sheet

FIG. 1
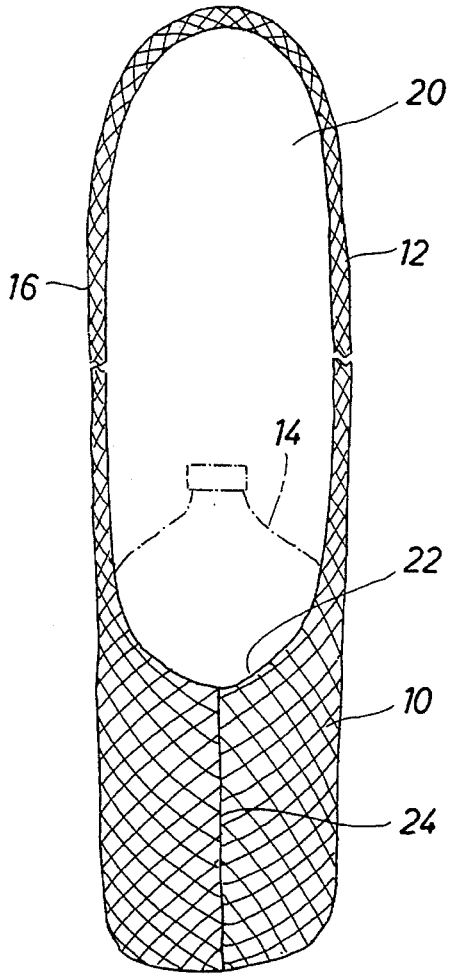
FIG. 2
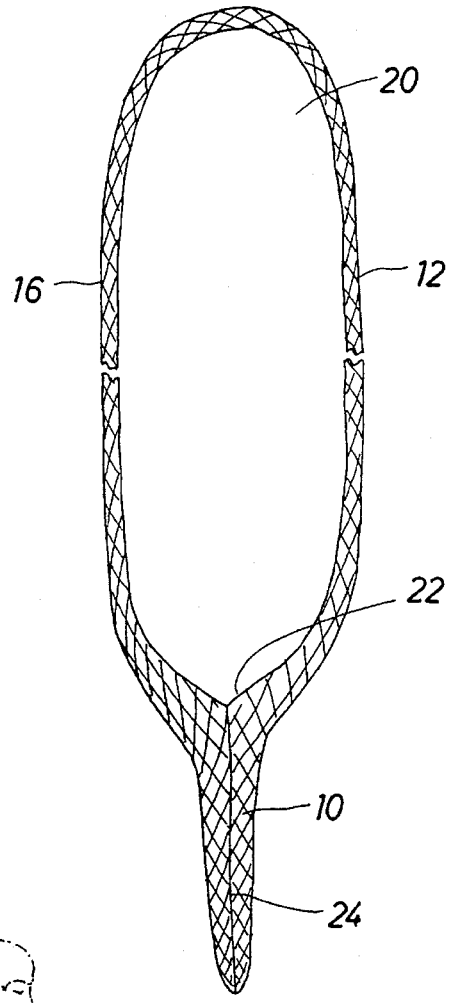
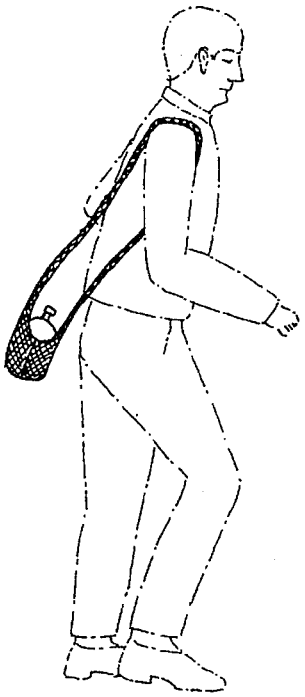
FIG. 3

MESH LIQUID CONTAINER CARRIER

BACKGROUND-FIELD OF INVENTION

This invention relates to a device used to carry a liquid container made of a mesh or net type material.

BACKGROUND-DESCRIPTION OF PRIOR ART

Individuals commonly carry a bottle of water in their hand.

A device was invented that resembled a vinyl bag with a strap on it. The device made of a vinyl material was useful and was commonly manufactured with a company name printed on the outside of the bag and it was very desirable for advertising. However, the vinyl bag device lacked flexibility that would allow it to expand to various sizes and shapes of bottles often used by companies that sell water in a bottled form.

Other devices have been invented to hold various specific sizes of containers, however they all seem to lack flexibility and versatility for todays current bottled water containers.

None of the former devices allow the expandability of a mesh carrying container device that neatly holds liquid containers or bottles of various sizes and shapes.

OBJECTS AND ADVANTAGES

A mesh liquid container carrier has many advantages as follows:

a.) Ease of manufacturing. The mesh carrier needs no additional components other than mesh. The mesh material for the mesh carrying device can be ordered in a proper tube or diameter size so that the mesh material can be laid flat and easily joined together on two sides in a small area that will create an expandable pocket, where a liquid bottle can reside.

b.) The area of the mesh tube which is not attached on the sides creating a small pocket will remain unattached. The unattached area creates a strap. This strap which is comprised of the longitudinal embodiment of the mesh that is not joined together on the sides creating the pocket can be easily tied into a knot by a human. Therefore, adjusting the length to the appropriate size for any individual.

c.) The mesh liquid container carrying device needs no other material then the mesh. The mesh liquid container carrying device needs no straps made of a material other than mesh or any adjusting devices or clips.

d.) Expandability. Because the mesh liquid container carrying device is made comprising of mesh, its pocket where the liquid container resides will easily expand or shrink because of the gravitational weight of the container of liquid so that the pocket of the mesh carrying device therefore posses a contiguous neat and uniform appearance.

e.) Manufacture cost. Because the mesh liquid container carrying device comprises of mesh material the cost of the device will be minimized due to the common ability of mesh manufactures to manufacture mesh to a tube diameter size and length desired. Therefore this can minimize the cost and ease of construction so that the entire device can made by joining only a small part on each side of the mesh tube to create a pocket and the entire device is created. The mesh tube that is not joined together creating the tube, therefore creates the strap of the device that can easily be adjusted by tieing a knot in the strap.

Individuals with common knowledge of articles made of mesh material would commonly perform the joining operation of the mesh by sewing. However, the method of joining the mesh together should be decided upon by the manufacture at the time of construction. It should also be the decision of the manufacture on what exact lengths the manufacture will manufacture the mesh material for the mesh liquid container carrying device. This would be determined by the quantity of the order. If mesh was manufactured in an improper length than additional areas of joining the mesh material may be necessary.

DRAWINGS FIGURES

FIG. 1 is a side view of the mesh carrying device to illustrate the present invention with its association of a water bottle. This figure shows the mesh material joined by way of a seam.

FIG. 2 is a side view of the mesh carrying device without the association of the water bottle. This figure illustrates the single contiguous loop of mesh that is joined together in a small area on each side of the panels near the bottom and continuing to the end of the mesh material to create a pocket.

FIG. 3 illustrates the mesh carrying device in use.

The extended panels of the pocket in FIG. 1 and 2 have been fragmented in order to conserve space.

DESCRIPTION OF THE PREFERRED EMBODIMENT

Referring now specifically to the drawings, the entire embodiment of the Mesh Liquid Container Carrier is made of mesh 10 and includes two side panels 12 and 16 and extend from the pocket 22 and create a loop 20 that can be worn around the shoulder of a human to carry a bottle 14 in the pocket 22 created by joining the mesh material together by way of a seam 24.

The drawing figures are intended to illustrate the uniqueness of this device. It is intended for this device to be made from a single embodiment or member of mesh material without any connections other than specified to create the pocket to hold the bottle. The mesh material should therefore be manufactured at a length long enough to fit around the shoulder of a human so that the bottle will hang near the waist of a human. The only areas where the mesh loop is to be joined, to create a pocket, is at a small area opposite the top end that hangs over the shoulder of a human. The mesh material should be made of a soft comfortable material that can be easily dyed, so that the device can be fashionable. The softness of the material will also allow the user to tie the unattached panels together in a knot at any area opposite the pocket end, therefore adjusting the length of the embodiment so that the device can be adjusted to fit any normal human so that the liquid bottle will hang near the waist of a human comfortably.

It should be noted that if the manufacture does not manufacture the mesh embodiment to the proper diameter length so as not making it possible to join the mesh on each side of the panels near one end to create the entire device, then additional area of joining the mesh material may be necessary.

SUMMARY, RAMIFICATIONS, AND SCOPE

Accordingly, the reader can see that the mesh liquid container carrying device made of mesh, is a device that offers its user and manufacture many unique advantages.

It is easy to manufacture and can be easily constructed of mesh material. The device can be manufactured free from other components that are not mesh and can easily be manufactured by joining two sides on one end of a tube of mesh to create a small pocket where a liquid container can reside. The joining of this mesh material can be commonly performed by those with knowledge of manufacturing articles of mesh.

The mesh liquid container carrying device possesses an appearance that is of an article of a contiguous embodiment of the same material type and posses a neat uniform contiguous appearance. The mesh material for the mesh liquid container carrying device can be easily dyed or manufactured in various colors creating a device that is both useful and fashionable.

The mesh liquid carrying device needs no adjusting devices or straps since the area of the longitudinal embodiment of the mesh that is not joined together creating its pocket creates the strap or loop which can easily be tied in a knot to adjust its length so that it can be used for all individuals.

Although the description of this article may contain specifications, these should not be construed as limiting the scope of this invention but merely providing illustrations of the presently preferred embodiment of this invention. For example the size and the length of the invention or the size of the mesh could vary. It could also be manufactured in other various shapes other than those shown.

Thus the scope of this invention should be determined by the appended claims and their legal equivalents, rather than by the examples given.

I claim:

1. A carrying device for a bottle, said device comprising:

a one-piece tubular member formed of a net-like, mesh material, said tubular member having a length, a constant diameter along said length and open circular ends each being defined by a peripheral edge, each of said ends further having a bottom portion and an upper portion wherein opposing sides of said bottom portion along said peripheral edge engaging one another and being seamed together to define a pocket having opposing panels sized and configured to receive the bottle and the opposing sides of said upper portion being un-seamed thereby defining un-seamed opposing panels which form a loop sized and configured to be received about the shoulder of a person whereby said panels of said pocket and said panels of said loop are of equal width and such that said pocket is suspended near the waist of the person.

* * * * *